US005824463A

United States Patent [19]

Arrington

[11] Patent Number: 5,824,463

[45] Date of Patent: Oct. 20, 1998

[54] METHOD TO INCREASE THE PRODUCTION RATE OF PHOTOGRAPHIC PAPER THROUGH APPLICATION OF OZONE

[75] Inventor: Eric E. Arrington, Rochester, N.Y.

[73] Assignee: Eastman Kodak Company, Rochester, N.Y.

[21] Appl. No.: 823,527

[22] Filed: Mar. 24, 1997

[51] Int. Cl.[6] ..... G03C 1/795; G03C 1/775; G03C 1/79

[52] U.S. Cl. ..... 430/532; 430/531; 430/536; 430/538; 430/935; 427/533; 427/323; 427/561; 528/483

[58] Field of Search ..... 430/532, 538, 430/531, 536, 935; 427/533, 561, 326; 528/483

[56] References Cited

U.S. PATENT DOCUMENTS

| | | | |
|---|---|---|---|
| 3,411,908 | 11/1968 | Crawford et al. | 430/538 |
| 3,501,298 | 3/1970 | Crawford | 430/538 |
| 3,582,337 | 6/1971 | Griggs et al. | 430/532 |
| 3,592,731 | 7/1971 | Griggs | 162/164 |
| 4,352,861 | 10/1982 | Meer | 430/532 |
| 4,481,289 | 11/1984 | Honma | 430/532 |
| 5,147,678 | 9/1992 | Foerch et al. | 427/40 |
| 5,173,397 | 12/1992 | Nada et al. | 430/532 |
| 5,326,624 | 7/1994 | Tsubaki et al. | 430/538 |
| 5,332,623 | 7/1994 | Dethlefs | 430/538 |
| 5,503,968 | 4/1996 | Lee | 430/532 |

*Primary Examiner*—Richard L. Schilling
*Attorney, Agent, or Firm*—Carl F. Ruoff

[57] ABSTRACT

This invention describes a method for manufacturing a photographic support which includes providing a support and laminating a surface of the support with a polymer resin formulation containing from 0.001 to 1 weight percent antioxidant at a temperature of from 305° to 360° C. while exposing the polymer resin formulation to an ozone containing gas at a rate of greater than 0.1 mg/m$^2$ of said support.

14 Claims, No Drawings

METHOD TO INCREASE THE PRODUCTION RATE OF PHOTOGRAPHIC PAPER THROUGH APPLICATION OF OZONE

FIELD OF THE INVENTION

This invention relates to a process for producing thermoplastic coated photographic paper by extrusion coating, and more particularly to a process for producing thermoplastic coated paper at high speed with good bond and few gel imperfections.

BACKGROUND OF THE INVENTION

This invention relates to a method for manufacturing resin coated paper support appropriate for use in photographic applications. Specifically, a technique is described where the polymeric resin layer can be laminated onto the paper base at high speed.

The maximum speed at which a polymeric coating can be applied to a photographic paper base is often limited by the bond strength between the paper and the polymer. As speed increases, the strength of the bond between the polymer and the paper tends to decrease. This is a key consideration in the manufacture of photographic paper supports, since chemicals used in the aqueous photographic processing will tend to penetrate into the support between the polymer and the paper if the bond is poor. This will leave unsightly marks around the edges of the paper after processing.

It is therefore necessary to compromise between a high speed production process and a high quality photographic product. One way to overcome this is to increase the temperature of the polymer. This method is appropriate as long as the temperature is not too high that decomposition of the polymer results in deleterious physical properties or photoactive substances which will fog the emulsion. Griggs (U.S. Pat. No. 3,582,337) claims polymer extrusion temperatures of from 304° C. to 343° C. to be used at speeds of between 61 and 305 m/min. Unfortunately, though these temperatures are adequate to assure reasonable bond, thermal degradation in the polyolefin results in occasional product imperfections (as mentioned in U.S. Pat. No. 5,503,968), which are not tolerable by today's discerning customers. These imperfections have since been reduced by the addition of antioxidants such as 4,4'-butylidene-bis(6-tert-butyl-meta-cresol). These antioxidants are adequate for reducing spot imperfections, however they also degrade bond considerably. Thus, it is no longer possible to run at the speeds claimed by Griggs and still achieve good bond at these temperatures.

Another way to overcome poor bond is to use corona discharge treatment as described in U.S. Pat. No. 3,411,908. This technique is applied to the paper base before laminating. The corona discharge technique tends to "activate" the surface resulting in better bond once the polymer is applied. Another technique which has been used is the application of flame as described in U.S. Pat. No. 5,147,678. This approach uses the flame caused by the burning of natural gas which impinges on the paper support. Again, this technique activates the paper, giving it better bond after the polymer is applied. One possible disadvantage of this technique is the possibility that flame treatment dries out the paper. Since moisture is necessary to facilitate the curing of the hardener in the photographic emulsion, this reduced moisture can diminish productivity in the sensitizing operation. Honma (U.S. Pat. No. 4,481,289) describes the use of ozone which can be applied to the molten polymer. This method activates the polymer instead of the paper support, again increasing the bond after the polymer is laminated onto the paper. In this application, Honma claims a maximum polymer extrusion temperature of 300° C. A maximum speed of 183 m/min is demonstrated which Lee (U.S. Pat. No. 5,503,968) points out is rather slow in today's environment. Lee describes a synergistic effect when flame is used in conjunction with ozone and demonstrates that speeds of greater than 400 m/min are possible. Unfortunately, as described above, this may have the disadvantage of drying the paper.

There is a great need for a polymer coating process which can be run at speeds greater than 305 m/min without drying the paper, creating gels, or creating photoactive products which will fog the photographic emulsion.

SUMMARY OF THE INVENTION

This invention describes a method for manufacturing a photographic support which includes providing a support and laminating a surface of the support with a polymer resin formulation containing from 0.001 to 1 weight percent antioxidant at a temperature of from 305° to 360° C. while exposing the polymer resin formulation to an ozone containing gas at a rate of greater than 0.1 mg/m$^2$ of said support.

DESCRIPTION OF PREFERRED EMBODIMENTS

In the preparation of a thermoplastic coated paper for photographic paper base in accordance with this invention, a thermoplastic resin is prepared from any coatable polyolefin material known in the photographic art. Representative of these materials are polyethylene, polypropylene, polystyrene, polybutylene, and copolymers thereof. The polyolefin can be copolymerized with one or more copolymers including polyesters, such as, polyethylene terephthalate, polysulfones, polyurethane's, polyvinyls, polycarbonates, cellulose esters, such as cellulose acetate and cellulose propionate, and polyacrylates. Specific examples of copolymerizable monomers include vinyl stearate, vinyl acetate, acrylic acid, methylacrylate, ethylacrylate, acrylamide, methacrylic acid, methylmethacrylate, ethyl-methacrylate, methacrylamide, butadiene, isoprene, and vinyl chloride. Preferred polyolefins are film forming and adhesive to paper. For the emulsion side resin, Polyethylene of low density, between 0.91 g/cm$^3$ and 0.94 g/cm$^3$ is preferred. Polyethylene having a density in the range of from about 0.94 grams/cm$^3$ to about 0.98 grams/cm$^3$ is most preferred for the back side layer. The polyolefin to be applied to the side of the paper whereupon the photographic emulsion will be applied includes a suitable optical brightener such as those described in Research Disclosure Issue N. 308, December 1989, Publication 308119, Paragraph V, Page 998, in an amount of from about 0.001 to about 0.25 percent by weight based on the total weight of the polyolefin coating, including any white pigment present, with 0.01 to about 0.1 percent being the most preferred. Any suitable white pigment may be incorporated in the polyolefin layer, such as, for example, titanium dioxide, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The pigment is used in any form that is conveniently dispersed within the polyolefin. The preferred pigment is titanium dioxide in the anatase crystalline form. Preferably, the white pigment should be employed in the range of from about 3 to about 35 percent by weight, based on the total weight of the polyolefin coating. Anatase titanium dioxide at from about 5 to about 20 percent is most preferred.

In addition to the brightener mixture and the white pigment, the polyolefin coating must contain an antioxidant such as 4,4'-butylidene-bis(6-tert-butyl-meta-cresol), di-lauryl-3,3'-thiodipropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), combinations of the above, and the like, in concentrations of from 0.001% to 1%. Heat stabilizers may be included, such as higher aliphatic acid metal salts such as magnesium stearate, calcium stearate, zinc stearate, aluminum stearate, calcium palmitate, sodium palmitate, zirconium octylate, sodium laurate, and salts of benzoic acid such as sodium benzoate, calcium benzoate, magnesium benzoate and zinc benzoate; calcium stearate of concentrations between 0.1 and 1.0% with 0.4–0.6% being most preferred. Addition of antistatic agents; lubricants; dyes; and the like, is well known to those skilled in the art. Additionally, emulsion side resins can contain one or more pigments, such as the blue, violet or magenta pigments described in U.S. Pat. No. 3,501,298, or pigments such as barium sulfate, colloidal silica, calcium carbonate and the like, with the preferred colorant combination consisting of cobalt aluminate and quinacridone, present in concentrations of between 0.02 to 0.5% and 0.0005 to 0.05% respectively, with the most preferred concentrations being from 0.1 to 0.2% and 0.001 to 0.003% respectively.

The back side resin also can consist of any extrudable polymer known in the photographic art, and contains from 0.01 to 1% of an antioxidant such as those previously mentioned.

The paper base material employed in accordance with the invention can be any paper base material which has heretofore been considered useful for a photographic support. The weight and thickness of the support can be varied depending on the intended use. A preferred weight range is from about 20 g/m$^2$ to about 500 g/m$^2$, with about 100–200 g/m$^2$ being the most preferred. Preferred thickness (those corresponding to commercial grade photographic paper) are from about 20 $\mu$m to about 500 $\mu$m with the most preferred thickness being from 100–200 $\mu$m. It is preferred to use a paper base material calendered to a smooth surface. The paper base material can be made from any suitable paper stock preferably comprising hard or softwood. Either bleached or unbleached pulp can be utilized as desired. The paper base material can also be prepared from partially esterified cellulose fibers or from a blend of wood cellulose and a suitable synthetic fiber such as a blend of wood cellulose and polyethylene fiber.

As is known to those skilled in the art, the paper base material can contain, if desired, agents to increase the strength of the paper such as wet strength resins, e.g., the amino-aldehyde or polyamide-epichlorohydrin resins, and dry strength agents, e.g., starches, including both ordinary starch and cationic starch, or polyacrylamide resins. In a preferred embodiment of this invention, the amino-aldehyde or polyamide-epichlorohydrin and polyacrylamide resins are used in combination as described in U.S. Pat. No. 3,592,731. Other conventional additives include water soluble gums, e.g., cellulose ethers such as carboxymethyl cellulose, sizing agents, e.g., aldyl ketene dimers, sodium stearate which is precipitated on the pulp fibers with a polyvalent metal salt such as alum, aluminum chloride or aluminum salts.

Prior to the polyolefin extrusion step, the paper is treated with a corona discharge to improve the adhesion of the polyolefin to the paper support as described in U.S. Pat. No. 3,411,908.

The emulsion side polymer is melted and extruded through a coathanger die, horseshoe die, T-die or other die at a temperature of from 305° C. to 360° C., and exposed to an ozone stream with an ozone concentration of greater than 0.03 g/m$^3$, at an application rate of greater than 1 mg/m$^2$. The polymer is then brought into contact with the paper and laminated between a metallic chill roll and a polymer backing roll as is well known in the art.

The invention will be further illustrated by the following examples. In the bond tests used in the examples, the technique used to measure bond strength is TAPPI Std T 539 cm-88.

EXAMPLE 1

(Control)

The back side resin, consisting of 99.9% polyethylene of density 0.945 g/cc, is melted in a single screw extruder and is forced through a coat hanger die at a melt temperature of 330° C., and laminated with photographic grade paper support where the thickness of the paper is 165 $\mu$m, and the thickness of the polymer layer is 25 $\mu$m. The paper leaves the laminator at 310 m/min with poor bond.

EXAMPLE 2

Same as Example 1, except the melt curtain is treated with ozone at a rate of 60 mg/m$^2$ of support. The bond is very good.

EXAMPLE 3

Same as example 2, except the paper leaves the laminator at 350 m/min. The bond is still very good.

EXAMPLE 4

Same as example 2 except the melt temperature is 310° C. The bond is still very good.

EXAMPLE 5

Same as example 4 except the paper leaves the laminator at 350 m/min. The bond is still very good.

EXAMPLE 6

Same as example 2 except an emulsion side resin is used, consisting of 85.68% polyethylene of density 0.925 g/cc, 12.5% anatase $TiO_2$, 3.0% ZnO, 5% calcium stearate, 0.1%, 4,4'-butadiene-bis(6-tert-butyl-meta-cresol), and 0.05% bis (benzoxazolyl)-stilbene, and the a silver halide emulsion is coated on the resin. The emulsions were chemically and spectrally sensitized as described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.76 $\mu$m in edge length size. This emulsion was optimally sensitized by the addition of a colloidal suspension of aurous sulfide and heat ramped up to 60° C. during which time blue sensitizing dye BSD-1, 1-(3-acetamidophenyl)-5-mercaptotetrazole and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. Iridium dopant was added during the late stage of grain formation. The resultant emulsion contained cubic shaped grains of 0.30 $\mu$m in edge length size. This emulsion was optimally sensitized by addition of green sensitizing dye GSD-1, a colloidal suspension of aurous sulfide, heat digestion followed by the addition of 1-(3-acetamidophenyl)-5-mercaptotetrazole and potassium bromide.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium dopant was added during the sensitization process.

Coupler dispersions were emulsified by methods well known to the art, and the following layers were coated on a polyethylene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis (vinylsulfonyl methyl) ether at 1.95% of the total gelatin weight.

| | |
|---|---|
| Layer 1: Blue Sensitive Layer | |
| Gelatin | 1.530 g/m$^2$ |
| Blue Sensitive Silver (Blue EM-1) | 0.280 g Ag/m$^2$ |
| Y-1 | 1.080 g/m$^2$ |
| Dibutyl phthalate | 0.260 g/m$^2$ |
| 2-(2-butoxyethoxy)ethyl acetate | 0.260 g/m$^2$ |
| 2,5-Dihydroxy-5-methyl-3-(1-piperidinyl)-2-cyclopenten-1-one | 0.002 g/m$^2$ |
| ST-16 | 0.009 g/m$^2$ |
| Layer 2: Interlayer | |
| Gelatin | 0.753 g/m$^2$ |
| Dioctyl hydroquinone | 0.094 g/m$^2$ |
| Dibutyl phthalate | 0.282 g/m$^2$ |
| Disodium 4,5 Dihydroxy-m-benzenedisulfonate | 0.065 g/m$^2$ |
| SF-1 | 0.002 g/m$^2$ |
| Layer 3: Green Sensitive Layer | |
| Gelatin | 1.270 g/m$^2$ |
| Green Sensitive Silver (Green EM-1) | 0.263 g A g/m$^2$ |
| M-1 | 0.389 g/m$^2$ |
| Dibutyl phthalate | 0.195 g/m$^2$ |
| 2-(2-butoxyethoxy)ethyl acetate | 0.058 g/m$^2$ |
| ST-2 | 0.166 g/m$^2$ |
| Dioctyl hydroquinone | 0.039 g/m$^2$ |

-continued

| | |
|---|---|
| Phenylmercaptotetrazole | 0.001 g/m$^2$ |
| Layer 4: UV Interlayer | |
| Gelatin | 0.484 g/m$^2$ |
| UV-1 | 0.028 g/m$^2$ |
| UV-2 | 0.159 g/m$^2$ |
| Dioctyl hydroquinone | 0.038 g/m$^2$ |
| 1,4-Cyclohexylenedimethylene bis(2-ethylhexanoate) | 0.062 g/m$^2$ |
| Layer 5: Red Sensitive Layer | |
| Gelatin | 1.389 g/m$^2$ |
| Red Sensitive Silver (Red EM-1) | 0.187 g Ag/m$^2$ |
| C-3 | 0.424 g/m$^2$ |
| Dibutyl phthalate | 0.414 g/m$^2$ |
| UV-2 | 0.272 g/m$^2$ |
| 2-(2-butoxyethoxy)ethyl acetate | 0.035 g/m$^2$ |
| Diocty1 hydroquinone | 0.004 g/m$^2$ |
| Potassium tolylthiosulfonate | 0.003 g/m$^2$ |
| Potassium tolylsulfinate | 0.0003 g/m$^2$ |
| Layer 6: UV Overcoat | |
| Gelatin | 0.484 g/m$^2$ |
| UV-1 | 0.028 g/m$^2$ |
| UV-2 | 0.159 g/m$^2$ |
| Dioctyl hydroquinone | 0.038 g/m$^2$ |
| 1,4-Cyclohexylenedimethylene bis(2-ethylhexanoate) | 0.062 g/m$^2$ |
| Layer 7: SOC | |
| Gelatin | 1.076 g/m$^2$ |
| Polydimethylsiloxane | 0.027 g/m$^2$ |
| SF-1 | 0.009 g/m$^2$ |
| SF-2 | 0.004 g/m$^2$ |
| Tergitol 15-S-5 ™ | 0.003 g/m$^2$ |
| DYE-1 | 0.018 g/m$^2$ |
| DYE-2 | 0.009 g/m$^2$ |
| DYE-3 | 0.007 g/m$^2$ |

The paper/polyethylene bond was very good.

The invention has been described in detail with particular reference to certain preferred embodiments thereof, but it will be understood that variations and modifications can be effected within the spirit and scope of the invention.

What is claimed is:

1. A method for manufacturing a photographic support comprising:

providing a support;

laminating a surface of said support with a polymer resin formulation containing from 0.001 to 1 weight percent antioxidant at a temperature of from 344° to 360° C. while exposing the polymer resin formulation to an ozone containing gas at a rate of greater than 0.1 mg/m$^2$ of said support.

2. The method of claim 1 wherein the polymer resin formulation is selected from the group consisting of polyethylene, polypropylene, polystyrene, polybutylene, polyethylene terephthalate, polysulfones, polyurethanes, polyvinyls, polycarbonates, cellulose esters, and polyacrylates.

3. The method of claim 1 wherein the polymer resin formulation comprises polyethylene having a density of between 0.87 g/cm$^3$ and 0.98 g/cm$^3$.

4. The method of claim 1 wherein the polymer resin formulation further comprises an optical brightener.

5. The method of claim 1 wherein the polymer resin formulation further comprises a pigment selected from the group consisting of titanium dioxide, zinc oxide, zinc sulfide, zirconium dioxide, white lead, lead sulfate, lead chloride, lead aluminate, lead phthalate, antimony trioxide, white bismuth, tin oxide, white manganese, and white tungsten.

6. The method of claim 5 wherein the pigment comprises from about 3 to about 35 percent by weight of the polymer resin.

7. The method of claim 1 wherein the antioxidant is selected from the group consisting of 4,4'-butylidene-bis(6-tert-butyl-meta-cresol), di-lauryl-3,3'-thiodipropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, and octadecyl 3-(3',5'-di-tert-butyl-4'-hydroxyphenyl propionate).

8. The method of claim 1 wherein the polymer resin formulation further comprises heat stabilizers, antistatic agents; lubricants and dyes.

9. The method of claim 1 wherein the support comprises a paper base material having a weight of from 20 $g/m^2$ to about 500 $g/m^2$.

10. The method of claim 9 wherein the paper base material further comprises wet strength resins, dry strength agents, water soluble gums, and sizing agents.

11. The method of claim 1 further comprising:

applying a corona discharge to the surface of said support prior to laminating the surface of said support with said polymer resin formulation.

12. The method of claim 1 further comprising:

applying a light sensitive silver halide emulsion to the polymer resin formulation.

13. The method of claim 1 wherein the ozone is applied at a rate of between 0.1 and 10 $mg/m^2$.

14. The method of claim 1 wherein the ozone is applied at a rate of between 10 and 100 $mg/m^2$.

* * * * *